United States Patent [19]

Fujii et al.

[11] 4,111,539

[45] Sep. 5, 1978

[54] ELECTROSTATIC PRINTING MASTER APPARATUS

[75] Inventors: Motoharu Fujii, Tokyo; Takao Muramatsu, Yokohoma; Noboru Koumura, Tokyo; Susumu Sugiura, Yamato; Nobuhiro Takekawa, Tokyo; Syusei Tsukada, Sagamihara, all of Japan

[73] Assignee: Canon Kabushiki Kaisha, Tokyo, Japan

[21] Appl. No.: 760,854

[22] Filed: Jan. 21, 1977

[30] Foreign Application Priority Data

Jan. 26, 1976 [JP] Japan ..... 51-7752

[51] Int. Cl.[2] ..... G03G 15/00

[52] U.S. Cl. ..... 355/3 R; 355/3 TR

[58] Field of Search ..... 355/3 R, 3 TR, 12

[56] References Cited

U.S. PATENT DOCUMENTS

| | | | |
|---|---|---|---|
| 3,549,251 | 12/1970 | Olden | 355/12 X |
| 3,615,128 | 10/1971 | Bhagat | 355/3 R |
| 3,754,820 | 8/1973 | Sheffo et al. | 355/3 R |
| 3,795,442 | 3/1974 | Kimura et al. | 355/3 R |

*Primary Examiner*—A. D. Pellinen

*Attorney, Agent, or Firm*—Fitzpatrick, Cella, Harper & Scinto

[57] ABSTRACT

The electrostatic printing apparatus includes a device for making an electrostatic printing master having thereon an electrical resistance pattern by applying image light of an original on an image forming member and heating the member, a rotatable member for carrying thereon the printing master, a charge image forming device which applies electric charges to the master, a developer for developing the charge image, transfer device for transferring the developed image onto a transfer material, a cleaner for cleaning the master after the transfer, and a device for removing and discharging the master.

3 Claims, 10 Drawing Figures

| FIG. 8A | FIG. 8B |
|---|---|

ELECTROSTATIC PRINTING MASTER APPARATUS

BACKGROUND OF THE INVENTION 1. Field of the Invention

This invention relates to an apparatus for printing data from a facsimile receiver set, an electronic computer or the like, and particularly to an electrostatic printer for printing a single type of data in a great volume.

More particularly, the invention relates to an electrostatic printer which is capable of providing prints on multiple sheets of plain paper by including means for converting into light signals the electrical data signals from a facsimile receiver set, an electronic computer or the like, and means for applying the light signals to an image formation member to thereby visualize the image thereon and for making the image formation member into an electrostatic printing master having an electrical resistance pattern formed thereon, and by repetitively subjecting the electrostatic printing master to the major steps of charging, development and image transfer.

2. Description of the Prior Art

In recent years, the following have come into use as the apparatus for recording the electrical data signals from a facsimile receiver set, an electronic computer or the like and as the recording medium therefor.

As the recording system, there are mechanical impact line printers of the drum type, multistylus electronic printers, printers utilizing CRT and electrophotography, etc. The mechanical impact line printers have been disadvantageous in that they are limited in speed and very noisy and poor in reliability. The multistylus electrostatic printers have been limited in resolving power and require expensive electrostatic recording paper to be used as the recording medium. The printers utilizing CRT have offered the problem that the sensitivity of the photosensitive medium becomes insufficient when such printers are adapted for high-speed operation.

In any of these recording systems, it has been necessary to provide separate copiers in order that the record data may be obtained in the form of plural prints, and this has led not only to the requirement of the space available for such copies to be installed, but also to the waste of expenses or maintenance of the apparatus or the waste of time.

As the low-speed recording such as facsimile or the like, there may be mentioned the discharge breakdown recording, the electrolytic recording, etc.

In the discharge breakdown recording, a layer of white pigment is provided on a black conductive layer or a thin layer of conductive material such as aluminum or the like is provided on a black layer, and discharging of a recording needle (hereinafter referred to as the stylus) is used to form apertures in the surface layer to expose the underlying black layer, thereby providing an image.

On the other hand, in the electrolytic recording system, paper is impregnated and wetted with electrolytic solution, and a current is supplied thereto from a stylus to thereby provide an image. The image so provided is formed of either a coloring substance resulting from the metal of the stylus having been ionized and reacted to the electrolyte or a cracked coloring product resulting from the electrolyte in the paper having been electrolyzed by the current from the stylus.

The discharge breakdown recording, however, is inconvenient in that the discharging heat from the stylus perforates the surface layer during the recording to create a very strong stimulant smell or to scatter the powdered material of the surface layer or to cause serious consumption of the stylus. Also, the black layer becomes exposed due to mechanical forces such as bending or pressure contact, so that the paper is liable to be stained. In addition, the surface layer is so thin as to readily permit occurrence of the discharge, and is not enough to completely cover the underlying black layer, and this causes the ground color of the recording paper to present gray instead of white, which leads to an unpleasant feeling of the paper. On the other hand, in the electrolytic recording which is of the wet type, the recording paper is so poor in preservability that the quality of image formed thereon tends to be deteriorated by blur. Further, after the recording, the paper tends to undergo waving or like deterioration due to drying. These are fatal disadvantages peculiar to the wet type recording.

Also, as disclosed in Japanese Patent Publications Nos. 22341/1963 and 29630/1969, there have been proposed the wet type electrifiable recording sheets in which electrically reducible metal compounds dispersed in an insulative resin material are reduced to free metals by passage of a current therethrough to thereby provide an image, but most of the relatively highly conductive metal compounds are colored while the less colored metal compounds are low in conductivity and therefore, some chemical treatment is required to permit passage of a current through the metal compounds. However, such treatment causes the metal compounds to be so much colored that the ground color density of the recording paper generally becomes higher. In addition, the low readiness of the metal compounds for passing the current therethrough would cause occurrence of discharge during the recording and the discharging heat would in turn produce an unpleasant smell or great consumption of the stylus. Further, Japanese Patent Publications Nos. 5476/1967 and 13239/1967 disclose the methods which use the technique of evaporation to form conductive skin films on white or transparent substances such as silica or the like, and thereafter disperse these into a matrix to permit passage of a current therethrough, but these methods also require considerable contrivances in the treating steps.

Thus, any of the conventional recording methods has lacked an effective dry type means for permitting passage of the current and raised various problems during the recording.

Further, where it is desired to obtain a plurality of prints from the image visualized by the above-described systems, such image has only served as a mere image original on the copying machine and this has led to waste as already described.

SUMMARY OF THE INVENTION

It is a primary object of the present invention to provide an electrostatic printing apparatus which, when recording the electrical data signals from a facsimile receiver set, an electronic computer or the like, records such data on an image formation member in the form of a visible image and electrical resistance pattern and which permits the image formation member to be used as an electrostatic printing master to thereby enable the same data to be provided as multiple sheets of printed data.

It is another object of the present invention to provide an electrostatic printing apparatus in which electrical signals are converted into light signals of high resolution and such light is recorded as a silver image on the electrostatic printing master, whereafter this image is printed on a sheet of plain paper through the electrostatic process and which permits the master itself to be used as the recorded image when multiple printed sheets are not required, because the silver image can generally be seen as a visible image.

It is still another object of the present invention to provide a novel electrostatic printing apparatus in which a thermosensitive photosensitive medium having a layer of insulative medium containing organic silver salt, reducing agent and a small amount of halide with respect to the organic silver salt and having a sufficient electrical resistance to retain an electrostatic charge is subjected to the step of applying light data signals by means for converting electrical data signals into light data signals and heating the same thereafter or simultaneously therewith, to thereby form a silver image in said medium, whereafter the medium is subjected to the main steps including the charging step, the developing step and the image transfer step.

It is yet still another object of the present invention to provide a novel electrostatic printing apparatus which includes the step of feeding the master from a light-intercepted cassette containing the master therewithin toward an exposure station by a signal, the step of applying signals to the master and thereafter, temporally storing the master and then carrying it out, the step or wrapping the master about a master supporting member, and the step of separating the master from the master supporting member after printing has been completed with respect to the master.

The invention will become more fully apparent from the following detailed description thereof taken in conjunction with the accompanying drawings.

DESCRIPTION OF THE PREFERRED EMBODIMENTS

Figure 1:
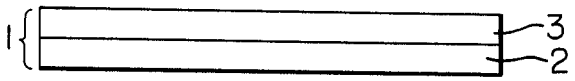
FIG. 1 shows an example of the image formation member (photosensitive medium) for forming the electrostatic printing master of the present invention.

To achieve the objects described above, we have used an image formation member having an insulative medium having a sufficient electrical resistance to retain electrostatic charge thereon and a layer formed chiefly by a silver image carried in said medium, and adopted the recording system of high resolution utilizing a laser or CRT and succeeded in obtaining records of high resolution and high quality. We have also been successful in recording a multiplicity of prints on plain paper at a high speed for an electrostatic printing master provided by the image formation member having the image formed thereon, and this has become an effective data processing system.

The features of the electrostatic printing method used with the present invention will now be described in comparison with the conventional electrostatic printing method. There are utilized a great number of conventional printing methods. Among these, the electrostatic printing forms a unique field of printing. The ordinary printing technique is based on selectively imparting ink to a surface of a printing master in accordance with the concavo-convexity formed on the surface of the printing master or with the different in affinity of the solvent, and urging paper against the printing master. In contrast, electrostatic printing is based not on mechanically (or physically) but electrostatically imparting ink (toner) to the printing master and transferring the image to paper. As regards the printing characteristic, the ordinary printing method can achieve multi-sheet printing at high speed because the ink remains relatively stably deposited on the pinting master while, on the other hand, the other portions of the printing master than the necessary portions may be contaminated by the ink. In contradistinction with this, the electrostatic printing does not ensure sufficiently stable deposition of the toner onto the printing master because the deposition of the toner is effected electrostatically and thus, it is not sufficiently effective for the high-speed printing which presupposes several printing conditions, and yet the electrostatic printing hardly offers the problem of contamination because it does not use the so-called ink. Thus, as viewed from the conventional technical point of view, the electrostatic printing is expected to contribute clean printing. Nevertheless, such utilization has not yet been realized sufficiently. The reason may be that the electrostatic printing is inferior to the ordinary printing in providing clear printed matter or providing multiple sheets of printed matter. For example, a typical example of the existing electrostatic printing master comprises an insulative image formed on a conductive back-up member or a conductive image formed on an insulative back-up member, and such image may be formed by depositing conductive lacquer in the form of an image on the back-up member or applying photosensitive lacquer on the back-up member, and then exposing the same to image light, thereafter selectively removing the unexposed or the exposed portion as by etching. It may be pointed out that the electrostatic printing master so constructed should be improved in numerous points regarding the definition of the print and the durability of the electrostatic printing master during the most common electrostatic printing process (for example, in the case of the master whose image-bearing portion is insulative, the recycle process of the charging step for causing the image-bearing portion to selectively retain charge thereon, the developing step effected by the toner charged to the polarity opposite to the imparted charge and the image transfer step for transferring the toner image to a transfer medium). For example, the conventional printing master has the image formed by the concavo-convexity as described above, and the concavo-convexity is damaged by the mechanical friction during the printing process to thereby induce irregular charging, which leads to poor durability of the master. Also, it is very difficult to ensure a high resolution by such concavo-convexity and this leads to technical difficulty in realizing the printing with a sufficient resolution. Further, the image formed by concavo-convexity makes it difficult to obtain an image having a half-tone or a harmony and accordingly, it is extremely difficult to print such an image.

Thus, the present invention provides an electrostatic printing master constructed to overcome the disadvantages peculiar to the conventional electrostatic printing master and creates new usages which avail of the features of such master.

The present master is an electrostatic printing master made by applying image light to an image formation member comprising an insulative medium having a sufficient electrical resistance to retain electrostatic charge thereon and a layer composed chiefly of silver carried in said medium, and thereby forming an electrical resistance pattern on the image formation member.

The intended characteristic of such electrostatic printing master is based on the fact that the silver forming the image is carried in the insulative medium and on such factors and the high resolution and continuous harmony of the image formed by the silver. Since the silver is carried in the insulative medium, the image on the master in its most typical construction is not formed by concavo-convexity and thus, the image is rarely damaged by mechanical friction, and this means the provision of a master which is excellent in durability. Also, the silver image is formed by aggregation of fine crystal grains of metallic silver and its resolving power is set by the level of the fine grains and accordingly, its resolution is excellent. Further, the density of the silver image can be varied by the density of the fine grains of the metallic silver in accordance with any desired continuous harmony, thus enabling a continuously harmonic image to be readily represented. Such excellent characteristics may be confirmed in the electrostatic printing system from the fact that the optically high resolution and continuous harmony of the silver image intactly contribute to the formation of an electrostatic latent image having a high resolution and continuous harmony and provides a print having a quality of image approximate to ordinary silver salt photography in any and all points. The most conspicuous feature of the present invention lies in that the silver image has the performance as an electrostatic printing master and contributes to the electrostatic printing without its high resolution and excellent harmony reproducibility of the silver image being hardly damaged.

The electrostatic printing master of the present invention is generally formed by applying photographic exposure to a silver salt photosensitive medium and is therefore incomparably more excellent than the conventional electrostatic printing master in sensitivity and panchromatism as well as in the fidelity and instantaneity of the record with respect to the image original to be printed.

The construction of the present master will hereinafter be described in detail.

The electrostatic printing master of the present invention is usually made from silver salt photosensitive medium and disclosed in our U.S. application Ser. No. 599,061 previously filed, now Pat. No. 4,069,759. FIG. 1 shows the typical construction of the silver salt photosensitive medium. The silver salt photosensitive medium 1 comprises a silver salt photosensitive layer 3 and a conductive back-up member 2. The silver salt photosensitive layer is composed chiefly of a conventionally used silver salt compound and an insulative medium. More specifically, some typical constructions of these may be layers of emulsions such as silver halide emulsion for photography, Lippmann emulsion for high resolution, emulsion for high resolving power dry plate and silver salt emulsion for plate making (e.g. direct positive emulsion). These emulsions are well-known photosensitive materials and may form a silver image by being subjected to the wet type developing treatment after exposure to light. Alternatively, the use of other photosensitive material would be particularly effective because of its simplicity, in order to enable the silver image to be subjected to the dry type treatment. As such, use may be made of a photosensitive material having an insulative medium containing organic silver salt, reducing agent and a small amount of halide with respect to the organic silver salt. Such photosensitive material permits a silver image to be formed by exposure to image light and heat-development and therefore enables the formation of an electrostatic printing master from an image original and the electrostatic printing process to be carried out continuously with instantaneity and thus, such photosensitive material is particularly recommendable in the present invention.

Figure 2:
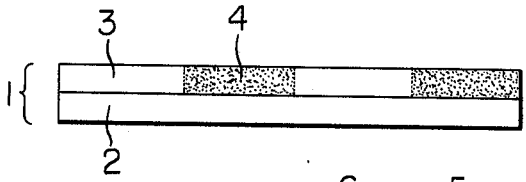
FIG. 2 shows the image formation member with a latent image formed thereon.
Figure 3:
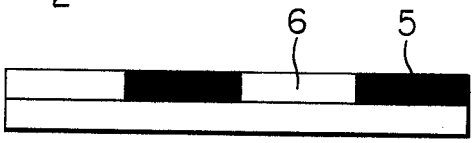
FIG. 3 shows an example of the electrostatic printing master of the present invention as finished.

The back-up member may be formed of sheet metal such as aluminum, copper, zinc or silver; metal-laminated paper; paper treated so as to prevent a solvent from entering the interior of the paper; paper treated with conductive polymer; synthetic resin film having an interface activator as an admixture; or glass or paper or synthetic resin or film having a metal or a metal oxide or a metal halide closely deposited on the back surface thereof by evaporation. Generally, the material forming the back-up member may be any material which has a surface resistivity lower than that of the photosensitive layer, namely, a surface resistivity below $10^9\Omega$.cm, preferably, below $10^5\Omega$.cm. Particularly desirable is a material such as suitably flexible metal sheet, paper or other conductive material which is designed to be wrapped about a drum, an endless belt or the like. The photosensitive medium so formed of one of these various image formation type photosensitive materials is exposed to image light to provide an electrostatic printing master, as a result of which a latent image 4 is formed on the exposed portion thereof as shown in FIG. 2. Subsequently, the photosensitive medium is subjected to the developing treatment to form a silver image 5 carried in the insulating medium, as shown in FIG. 3. No silver image is formed on the non-image-bearing portion 3. The electrical resistance of the silver-image-bearing portion may preferably be set to a value usually between several $\Omega$.cm and $10^{10}\Omega$.cm. Also, the electrical resistance of the non-image-bearing portion may preferably be set to a value from $10^{11}$ to $10^{14}\Omega$.cm. The thickness of the layer carrying the silver image therein is arbitrarily set chiefly from the viewpoint of the usage and durability, and most preferably set to 2–30 $\mu$.

Figure 4:
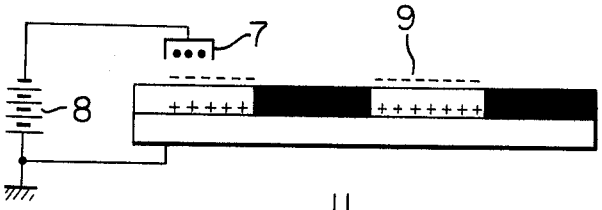
FIGS. 4 to 7 illustrate an example of the electrostatic printing process, FIG. 4 showing the charging step, FIG. 5 showing the developing step, FIG. 6 showing the image transfer step and FIG. 7 showing the cleaning step.
Figure 5:
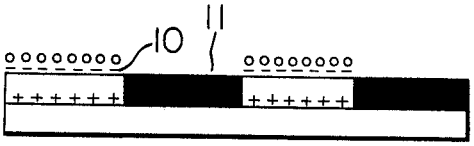
Figure 6:
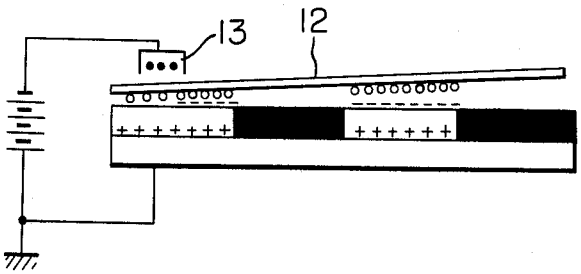
Figure 7:
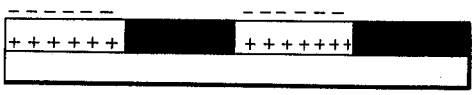

The basic process of the electrostatic printing is illustrated in FIGS. 4 to 7. By causing the master carrying thereon the silver image to pass as below a negative corona electrode 7 as shown in FIG. 4, negative charges 9 may be created on the surface regions of the master which bear no silver image. In this case, the negative corona electrode may be replaced by a positive one or an AC corona electrode. As the result, a latent image is formed by electrostatic charges selectively in the regions which bear no master silver image. Such image formed by the electrostatic charges, as shown in FIG. 5, may be subjected to the toner treatment by a conventionally used method such as cascade development, magnetic brush development, liquid development, magnedry development, water development or mist development. If the toner particles are electrically conductive and where no charge is particularly imparted to those particles or where the particles have charges opposite in polarity to the image formed by the electrostatic charges, these particles will stick to a region such as region 10 to which charges have been imparted. On the other hand, if these particles have electrically imparted thereto charges identical in polarity to the image formed by the electrostatic charges, these particles will stick to a region such as region 11 which has no charge. Next, as seen in FIG. 6, a transfer member 12 is brought into contact with the surface of the toner image, so that the toner image may be transferred to the transfer member by imparting corona charge from a corona electrode 13 opposite in polarity to the toner to the transfer member from the back thereof. The toner image so transferred may be fixed by a well-known technique. The fixation may usually be accomplished by heat-fixation or solvent-fixation but, where the liquid development has been employed, the toner may simply be dried. As a further alternative, pressure-fixation may be adopted. In order to remove any residual toner from the surface of the master, the master is then cleaned by cleaning means such as brush, fur brush, cloth or blade, as shown in FIG. 7.

The electrostatic printing process is carried out by the recycle of the above-described process of charging-development-transfer-cleaning or by the recycle of the process of development-transfer-cleaning utilizing the durability of the electrostatic latent image. If desired, the cleaning step may be eliminated. In some special cases, it will also be possible to form an image forming a sufficient amount of toner on the master during the first step, and transfer such image to different transfer members more than once, thereby producing duplicates.

The operation for obtaining an electrophotographic image may be effected by a conventional technique. For example, the means for imparting electrostatic charges may be to cause the master to pass several times below a corona discharger connected to a voltage source of +6KV to thereby impart positive charges to the master until the potential thereof reaches 0 to 1500 V.

The polarity of the corona discharge may be positive or negative DC corona or AC corona or else, the electrostatic charges may be imparted by bringing an electrode into direct contact with the photosensitive medium. The potential provided by the electrostatic charges is set to such a level which will never cause dielectric breakdown or sparking of the master or to a lower level.

A typical construction of the present electrostatic printing master is shown in FIG. 3, but the back-up member may be omitted if desired. In such a case, it is possible in the application of the master to the electrostatic printing process that the master is set on a conductive support plate or that simultaneous charging of the opposite surfaces of the master is adopted as the charging method (for example, corona discharges opposite in polarity are applied to the opposite surfaces of the master).

The main function and construction of the present electrostatic printing master have been described above. Other excellent features of such master may be pointed out in some further points. For example, the image is formed by the silver image as well and this means great stability of the image both chemically and physically, and very good preservation of the master during a long time. In addition, the master is excellent in resistance to light, heat, humidity, etc. Further, the fact that the master is the so-called usual silver image photographic image itself facilitates the confirmation of the data to be printed from the master and also enables the master itself to be utilized as the recorded data. These multiple usages are also the features of the present electrostatic printing master.

An example of the construction of the present master will now be shown.

Uniform slurry was prepared by mixing and crushing 20 grams of silver behenate, 150 grams of methyl ethyl ketone and 150 grams of toluene in a ball mill for 72 hours. Subsequently, 100 grams of 20% ethyl alcohol solution of polyvinyl butyral resin (produced and sold by Sekisui Chemical Co., Ltd. under the tradename of S-Lec BM-1) was added to the slurry and gently mixed together for about 3 hours. Next, 0.12 gram of mercury acetate, 0.2 gram of calcium bromide and 5.0 grams of phthalazinone were successively added to prepare a silver behenate layer-forming solution. This was uniformly applied to an aluminum plate of 100 $\mu$ thickness by means of a coating rod, and dried at 80° C. for 3 minutes.

Further, applied to said silver behanate layer was a mixed solution of 1.5 grams of 2,2'-methylene-bis-6-t-butyl-p-cresol, 0.3 gram of phthalazinone, 10 grams of 10% acetone solution of cellulose acetate (tradename: Daicel L-30 produced by Daicel Ltd.), 15 grams of acetone, and 0.005 gram of dye sensitizer (sensitization pigment)

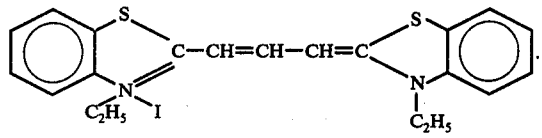

All these procedures were carried out in the dark.

Light energy of 20 $\mu J/cm^2$ from a CRT (cathode ray tube) whose peak was at 440 m$\mu$ was applied to the photosensitive plate so provided, whereafter the photosensitive plate was developed by being heated at 130° C. for 2 seconds by a roller type heating device, whereby a negative printed visible image was obtained. Then, corona discharge from a voltage source of −7KV was uniformly imparted to said plate, whereafter the plate was immersed in a body of liquid developer containing positively charged toner, and then there was obtained a positive toner image. A sheet of transfer paper was superposed on such toner image and corona discharge was imparted from the transfer paper side, whereupon there was obtained a clear transferred visible image. No deterioration in the surface of the photosensitive plate and no aggravation in quality of the transferred image was found after the above-described charging, development and transfer were repeated, and even after the transfer was repeated more than one thousand times. As the result, this photosensitive plate was found to be excellent as the master for repetitive printing.

Also, the silver image exhibits a faithful reproducibility with respect to an image original and therefore, an electrostatic charge image corresponding thereto was formed and the toner image was found to be a faithful photographic image corresponding thereto.

A second example is identical with the above-described first example with the exception that the back-up member is formed not of an aluminum plate but of a polyester film (Myler) of 70 $\mu$ thickness having aluminum evaporated thereon. In the case of such back-up member with aluminum evaporated thereon, in order to provide a number of copies each having a sufficient flexibility to be curled into a drum-like shape, the master is wrapped about a rotatable drum, and then subjected to the recycle process of charging, toner development (cascade development), transfer and cleaning on the rotating drum, whereby one thousand sheets of copy were simply obtained per minute. The copies obtained were all legible and quite clear.

Figure 8A:
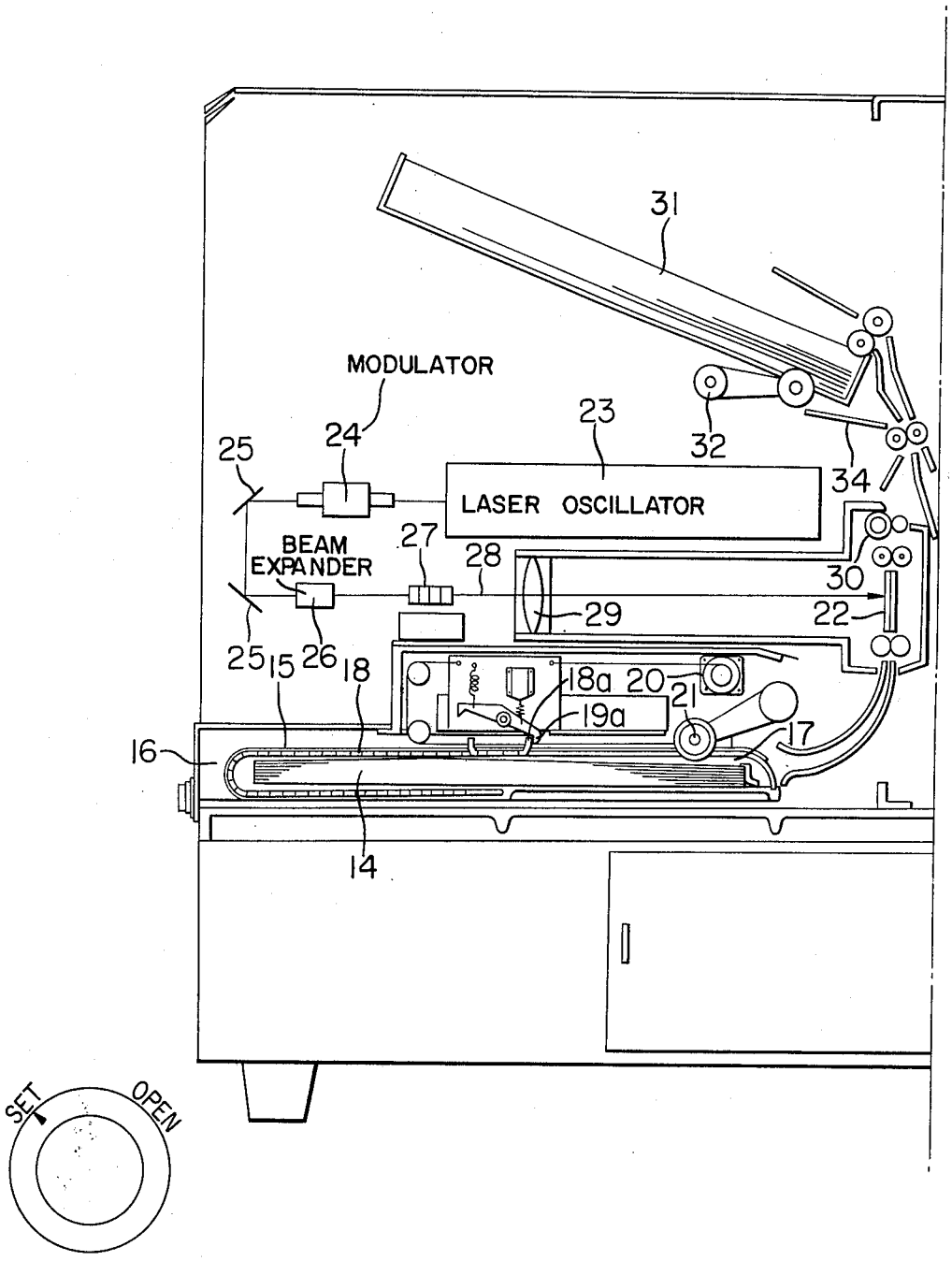
FIG. 8A being a profile view of the image formation device and FIG. 8B being a profile view of the fixing device.
Figures 8, 8B:
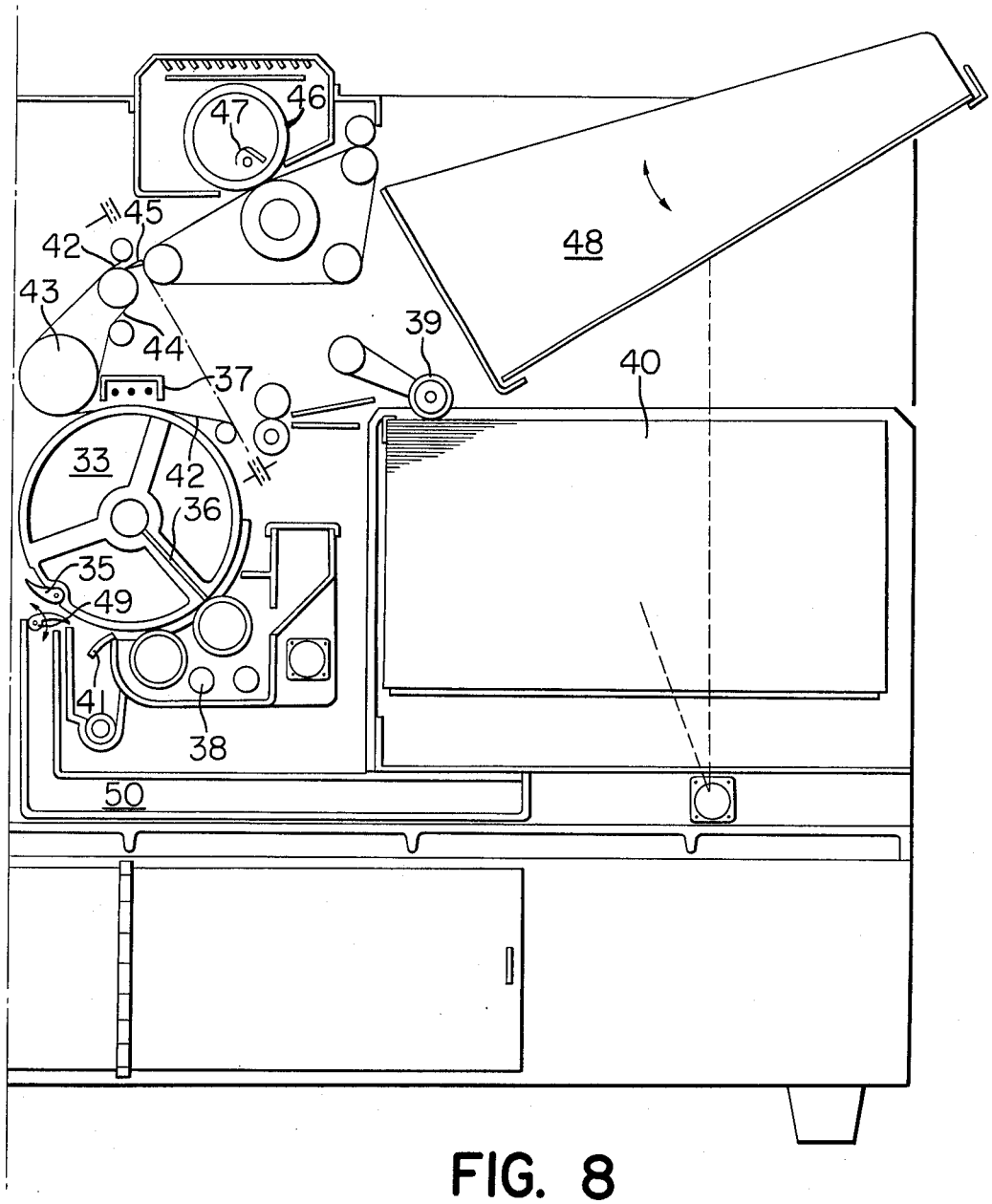
FIG. 8 illustrates the construction of an embodiment of the electrostatic printing apparatus according to the present invention in which an image formation device and a fixing device are joined.

An embodiment of the electrostatic printing apparatus of the present invention will hereinafter be described in detail by reference to FIGS. 8A and 8B.

Image formation members 14 which provide the electrostatic printing masters are contained within a cassette 16 having a shutter 15 for shielding the image formation members against extraneous light. When the cassette is placed in the apparatus and a stand-by instruction is given, the hook 19*a* of an opening-closing device is engaged with an opening-closing member 18 for opening and closing the output port 17 of the cassette and in this position, an opening-closing motor 20 is operated to move the opening-closing member leftwardly in FIG. 8A, thereby opening the outlet port. Substantially simultaneously therewith, an image formation member is fed to an image exposure station 22 at a speed of 5 cm/sec. by an image formation member feed roller 21, and exposed to image light at the exposure station. The image exposure device for applying such image light will now be discussed in detail. A laser beam oscillated from a laser oscillator 23 is directed to the input opening of a modulator 24. A mirror 25 is inserted to bend the light path to thereby reduce the space occupied by the apparatus, and may be eliminated if it is unnecessary.

The modulator 24 may be a well-known acousto-optic modulation element utilizing the acousto-optic effect or a well-known electro-optic element utilizing the electro-optic effect.

In the modulator 24, the laser beam is subjected to intense or weak modulation in accordance with the input signal to the modulator 24.

Where the laser oscillator 23 is a semiconductor laser or even a gas laser of the type in which current modulation is possible or a laser of the internal modulation type which has a modulation element incorporated in the path of oscillated light, the modulator 24 may be omitted and the laser beam is directly directed to a beam expander 26.

The laser beam from the modulator 24 has its beam diameter expanded by the beam expander while the beam remains a parallel beam. The laser beam having its diameter so expanded is further passed to a polygonal rotatable mirror 27 having one or more mirrored surfaces. The polygonal rotatable mirror 27 is mounted on a shaft supported by high-precision bearing (e.g. pneumatic bearing) and driven by a constant speed motor (such as hysteresis synchronous motor or DC servomotor). The laser beam 28 horizontally swept by the polygonal rotatable mirror 27 is focused as a spot on the image exposure station by a focusing lens 29 having $f$-$\theta$ characteristic. In the common focusing lens, when the incidence angle of light is $\theta$, there is the following relation with respect to the position $f$ on the image plane at which the image is focused:

$$r = f \cdot \tan\theta \quad (1)$$

where $f$ is the focal length of the focusing lens. Thus, the laser beam 28 reflected by a predetermined polygonal rotatable mirror 27 as in the present embodiment has its angle of incidence on the focusing lens 29 varied with time in the fashion of a linear-function. Therefore, the velocity of movement of the spot focused on the image formation member 14 which is the image plane is varied non-linearly and is not constant. In other words, the velocity of movement is increased at a point where the angle of incidence becomes greater. Thus, if the laser beam is turned on at a predetermined time interval and a row of spots is placed on the image formation member 14, the intervals between these spots are wider toward the opposite ends than at the middle portion of the row. To avoid such a phenomenon, the focusing lens is designed to have the following characteristic:

$$r = f \cdot \theta \quad (2)$$

Such focusing lens is called the f-$\theta$ lens.

Further, when a parallel beam is focused as a spot by a focusing lens, the minimum diameter dmin of the spot is given by $$d\min = f\,{}^{\lambda}/_{A}) \quad (3),$$

where $f$ is the focal length of the image focusing lens, $\lambda$ is the wavelength of the light and A is the entrance aperture of the focusing lens. Thus, when $f$ and $\lambda$ are constant, a smaller spot diameter dmin may be obtained by increasing the A. The aforementioned beam expander 26 is used to impart such effect. Therefore, where the necessary dmin may be obtained by the beam diameter of the laser oscillator, the beam expander 26 may be omitted.

The laser beam deflected and modulated in the manner as described is thrown upon the image formation member 14 while keeping light energy of about 25 $\mu J/cm^2$.

The image formation member having a latent image already formed thereon is then heat-developed at 130° C and at a rate of 0.1 sec./cm by a heat-developing roller 30, whereby the image formation member is finished as a master. The heat-developing device must be of such a construction that the master is not exposed to extraneous light until the heat-development is completed.

The master with the image so formed thereon is carried into a master reception box 31. When data comes on continuously, masters likewise produced come to be received in this reception box.

Where a plurality of image-recorded sheets are not desired, the master itself may be used as the final recorded image.

Although the master has been described as being provided by subjecting the image formation member to the laser beam and the heat-development, the heat-development may be eliminated if the laser beam is so high in energy as to provide heat as well.

Where a plurality of printed sheets are desired for a certain signal, the master therefor is conveyed from the bottom of the master reception box 31 toward a drum 33 by a transport roller 32.

At this time, a guide plate 34 for changing over the passageway of the master is suitably changed over to permit the master to reach the drum. The then leading edge of the master is held down by a gripper 35 and the drum is rotated counter-clockwisely. The trailing edge of the master is attracted to the drum by the suction from a suction port 36 in the drum. If the master is brought into contact with the drum while being squeezed by a rotatable drum (not shown) adapted to be urged against the drum, there may be provided uniform pressure contact between the drum and the master.

This completes the preparation for the electrostatic printing to be effected from the master. By a print instruction, the drum 33 is started to rotate counterclockwise at a velocity of 100 cm/sec. First, the master is subjected to uniform charging by a charger 37 connected to a voltage source of 8.5 KV. By this charging, an electrostatic latent image as shown in FIG. 4 is formed on the master and the master with the latent image formed thereon is toner-developed by a developing device 38 (e.g. magnetic sleeve). Two such magnetic sleeves are rotating at a peripheral velocity of 25 cm/sec. A transfer member 40 is fed to the developed master by a paper feed roller 39 and superposed on the master, whereafter corona is imparted from a charger 37 to the transfer member from the back thereof, thus accomplishing the transfer step. In the present embodiment, the charger serves the charging (for latent image formation) and the image transfer. In this system, ultimately, the corona charges partly act as the electric field for the image transfer and partly pass through the transfer member to the master to serve the latent image formation.

If required, the residual toner remaining on the master after the image transfer may be cleaned by a cleaner 41 and carried back to the developing step.

A separating belt 42, which may often be a metal belt or a plastics belt, is wrapped around a separating roller 43 to separate the transfer member from the master. Designated by 44 and 45 are guide belt and a separating pawl, respectively.

After the image transfer and the separation from the master, the transfer member 40 is carried to the fixing step, in which it is fixed by a known fixing device. In FIG. 8B, the fixing device is shown as an infrared heating-fixing device effective for rapid fixation. An infrared ray lamp 47 is contained within a glass cylinder 46. The lamp has a capacity of 2.5 KW and can fix the toner on paper of high quality moving at a velocity of 100 cm/sec. As soon as the transfer member is held down by the cylinder 46, the unfixed toner on the transfer member absorbs heat and melts for fixation. The finished printed sheet is carried onto a tray 48.

The basic construction and process of the present invention have been described above, but some supplemental description will be made hereinafter.

Our electrostatic printing master has the so-called negative-to-positive characteristic whereby silver is precipitated in the portion of the master exposed to light to form an image.

Therefore, where a single sheet as the last printed matter is required from a certain signal, namely, where the electrostatic printing is not necessary, light may be provided as the signal, but where the apparatus is used for the electrostatic printing, a reverse signal must be supplied. Nevertheless, control of such change-over may be electrically accomplished with great ease and without any problem.

It is also possible to solve the matter on the electrostatic printing side. For example, by using toner of the same polarity as that of the charge in the charging step and effecting the so-called inversion development whereby toner is deposited on the light portion (low potential portion), a positive image may be obtained without the light signal being changed over.

After a required number of copies have been printed from the master, the master is separated from the drum and discharged. In this case, the drum slowly rotates in the direction opposite to the direction in which it was rotated during the printing step, and when the then trailing edge of the master reaches the position of the master separating pawl 49, the pawl contacts the drum and substantially at the same time, air blows out of the suction port 36 to separate the trailing edge of the master from the drum. At last, the gripper 35 is released and the used master is discharged into a reception box 50.

The apparatus is shown as using a laser, whereas the use of the laser is not restrictive but a combination of the apparatus with CRT display or other display system is equally applicable to the present invention, although these are not described in detail herein because such combination only leaves a problem regarding the electrical signal source and the interface with the printer.

What we claim is:

1. An electrostatic printing apparatus comprising:

electrical resistance image formation means for making an electrostatic printing master having thereon an electrical resistance pattern corresponding to an optical image by applying image light upon an image formation member and heating said image formation member;

a rotatable member for carrying thereon said electrostatic printing master;

means for holding said electrostatic printing master on said rotatable member;

means for electrostatically charging said master to form a charge image thereon;

means for applying developer to said master having the charge image formed thereon;

means for transferring the developed image on said master onto a transfer member;

means for cleaning the surface of said master after transferring the developed image onto the transfer material; and means for removing and discharging said master after use, wherein said means for electrostatically charging said master serves also as the means for transferring the developed image onto the transfer member.

2. An apparatus according to claim 1, wherein the developer removed by said cleaning means is collected into the developing means.

3. An apparatus according to claim 1, wherein said electrical resistance image formation means includes means for emitting a laser beam.

* * * * *